US011452921B2

(12) United States Patent
Kline et al.

(10) Patent No.: US 11,452,921 B2
(45) Date of Patent: Sep. 27, 2022

(54) BRANDED WEIGHTING SYSTEM

(71) Applicant: Dunlop Sports Company Limited, Kobe (JP)

(72) Inventors: Michael J. Kline, Huntington Beach, CA (US); Denise L. Salvucci, Huntington Beach, CA (US)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 473 days.

(21) Appl. No.: 14/455,254

(22) Filed: Aug. 8, 2014

(65) Prior Publication Data

US 2016/0038795 A1 Feb. 11, 2016

(51) Int. Cl.

| | |
|---|---|
| ***A63B 53/00*** | (2015.01) |
| ***A63B 53/04*** | (2015.01) |
| *A63B 71/06* | (2006.01) |
| *A63B 43/00* | (2006.01) |

(52) U.S. Cl.

CPC ..... *A63B 53/047* (2013.01); *A63B 43/005* (2013.01); *A63B 2053/0491* (2013.01); *A63B 2071/0694* (2013.01)

(58) Field of Classification Search

CPC combination set(s) only.
See application file for complete search history.

(56) References Cited

U.S. PATENT DOCUMENTS 1,133,129 A * 3/1915 Govan ..... A63B 53/047 473/337
1,452,845 A * 4/1923 Pryde ..... A63B 53/08 473/343
2,155,830 A * 4/1939 Howard ..... A63B 60/52 473/246
2,332,342 A * 10/1943 Reach ..... A63B 53/04 473/248
2,660,436 A * 11/1953 Grossman ..... A63B 69/3617 473/237
3,749,408 A * 7/1973 Mills ..... A63B 53/0487 473/336

(Continued)

FOREIGN PATENT DOCUMENTS

JP 2001252379 A * 9/2001
JP 2006158935 A * 6/2006

OTHER PUBLICATIONS

Golf.com, Tour Customs: Unique details from pro's bags, Jul. 29, 2012, Golf.com, 10 pages.*

(Continued)

*Primary Examiner* — Eugene L Kim
*Assistant Examiner* — Matthew B Stanczak
(74) *Attorney, Agent, or Firm* — Stetina Brunda Garred and Brucker; Mark B. Garred

(57) ABSTRACT

A golf club may include a rear surface having first branding indicia, and a predefined region defined at least in part by a partially raised surface, a fully raised surface, a partially sunken surface, a fully sunken surface, a stepped surface, a textured surface, and a partially raised/partially sunken surface. The first branding indicia may be inside the predefined region. The golf club may also include a weighted tape with a second branding indicia placed on the rear surface of the golf club, preferably with a portion of the weighted tape being inside the predefined region.

12 Claims, 4 Drawing Sheets

(56) References Cited

U.S. PATENT DOCUMENTS 3,814,437 A * 6/1974 Winquist ..... A63B 53/04 473/350
4,323,246 A * 4/1982 Nehrbas, Jr. ..... A63B 69/3685 473/236
4,754,977 A * 7/1988 Sahm ..... A63B 53/047 473/337
4,869,507 A * 9/1989 Sahm ..... A63B 53/047 473/337
5,297,794 A * 3/1994 Lu ..... A63B 53/047 473/337
5,316,298 A * 5/1994 Hutin ..... A63B 53/04 473/332
5,409,229 A * 4/1995 Schmidt ..... A63B 53/04 473/332
5,478,078 A * 12/1995 Lee ..... A63B 69/3685 473/236
D372,285 S * 7/1996 Fortini ..... D21/748
5,588,923 A * 12/1996 Schmidt ..... A63B 53/047 473/340
5,609,530 A * 3/1997 Butler, Jr. ..... A63B 69/3617 473/237
5,626,530 A * 5/1997 Schmidt ..... A63B 60/00 473/324
5,669,826 A * 9/1997 Chang ..... A63B 53/047 473/332
5,776,010 A * 7/1998 Helmstetter ..... A63B 53/04 473/334
5,795,245 A * 8/1998 Chang ..... A63B 53/04 473/335
5,800,282 A * 9/1998 Hutin ..... A63B 60/02 473/291
5,833,551 A * 11/1998 Vincent ..... A63B 60/00 473/350
D418,886 S * 1/2000 Feng ..... D21/749
6,186,903 B1 * 2/2001 Beebe ..... A63B 60/00 473/248
6,206,790 B1 * 3/2001 Kubica ..... A63B 53/047 473/335
6,290,609 B1 * 9/2001 Takeda ..... A63B 60/02 473/335
6,405,450 B1 * 6/2002 Wood ..... A63B 53/047 33/759
6,409,612 B1 * 6/2002 Evans ..... A63B 53/04 473/324
D473,606 S * 4/2003 Mickelson ..... A63B 53/047 D21/747
6,773,361 B1 * 8/2004 Lee ..... A63B 60/00 473/335
6,780,119 B1 * 8/2004 Gankas ..... A63B 69/3685 473/236
7,004,852 B2 * 2/2006 Billings ..... A63B 53/0466 473/332
7,048,647 B2 * 5/2006 Burrows ..... A63B 60/02 473/334
7,887,432 B2 * 2/2011 Jones ..... A63B 53/0487 473/324
7,959,519 B2 * 6/2011 Zielke ..... A63B 53/04 473/249
8,057,322 B2 * 11/2011 Wallans ..... A63B 53/047 473/329
8,348,782 B2 * 1/2013 Park ..... A63B 53/047 473/291
2002/0115503 A1 * 8/2002 Erickson ..... A63B 53/0487 473/334
2003/0203763 A1 * 10/2003 Best ..... A63B 60/54 473/290
2003/0203764 A1 * 10/2003 Dabbs ..... A63B 60/00 473/291
2005/0090332 A1 * 4/2005 Burrows ..... A63B 60/02 473/345
2006/0183568 A1 * 8/2006 Bamber ..... A63B 53/047 473/349
2007/0026967 A1 * 2/2007 Schweigert ..... A63B 60/02 473/349
2007/0072693 A1 * 3/2007 Kallberg ..... A63B 69/3632 473/226
2007/0270237 A1 * 11/2007 Tavares ..... A63B 53/04 473/349
2008/0076593 A1 * 3/2008 Costa ..... G09F 23/00 473/316
2009/0247314 A1 * 10/2009 Matsunaga ..... A63B 53/047 473/291
2015/0051013 A1 * 2/2015 Ueda ..... A63B 53/047 473/342

OTHER PUBLICATIONS

Kanazawa, Machine Translation of JP Pat. No. 2006-158935A, uploaded Jun. 14, 2019, J-PlatPat, 13 pages.*
Honma, JP-2001252379-A machine translation, uploaded Jan. 11, 2022, Espacenet, 4 pages.*

* cited by examiner

BRANDED WEIGHTING SYSTEM

CROSS-REFERENCE TO RELATED APPLICATIONS

Not Applicable

BACKGROUND OF THE INVENTION

1. Field of the Invention

The present disclosure pertains generally to golf clubs and, more particularly, to a tape based weighting system which, when applied to a golf club head, effectively maintains the appearance of the branding indicia on the rear face thereof.

2. Description of the Related Art

Weighted tapes, for example, manufactured of lead and/or other metals or alloys, are known in the field of sporting goods, particularly in connection with golf clubs. Traditionally, weighted tapes have been used on golf clubs for two main purposes: 1) to alter the swing weight of the club, and 2) to move the center of gravity. This use of the weighted tape may help fine-tune the swing weight and/or center of gravity of the club to alter such characteristics relative to what is available on standard equipment in order to customize the club for the golfer's particular use. Such customization may translate into hitting better shots, which in turn may help boost the golfer's morale and performance. Thus, the use of weighted tape is common and wide spread.

Previous uses of weighted tape in the golf industry, however, have been inefficient. Golfers use their best judgment to tear off a piece of weighted tape with unknown weight and apply it, often indiscriminately, to any place on the golf club. More often than not, using weighted tape has meant that one or more weighted tape pieces usually end up being applied on top of the branding indicia on the golf club. This leads to obscuring the brand and the message on the golf club.

Thus, the previous usage of weighted tape was inefficient in increasing the swing weight of the golf club and also in moving the center of gravity. It also obscured the brand name and message of the club.

In view of the aforementioned deficiencies in the art, there is a need for a tape based golf club head weighting system which, when applied to a golf club head, effectively maintains the appearance of the branding indicia on the rear face thereof, while also providing desired weight modification characteristics.

BRIEF SUMMARY OF THE INVENTION

In one embodiment, a golf club head may have first branding indicia, which may, for example be a logo, picture, pattern, graphics, or text of any kind. This golf club head may also comprise a weight having second branding indicia thereon. The second branding indicia may be substantially similar to the first branding indicia. The golf club may also have a predefined region encompassing, at least in part, the first branding indicia. This predefined region may be sized, shaped and located depending on the location of the center of gravity. The predefined region may include at least a portion of the first branding indicia. The weight may have a size and shape substantially similar to the first predefined region.

Moreover, the weight may, in some cases, only be applied to the exterior surface of the golf club. The weight may be applied as a singular weight or a combination of weights, each weight being substantially similar to the other in size and shape, and all of the weights being substantially similar in size and shape to the predefined region on the golf club.

In another embodiment, a golf club head may include a rear surface with first branding indicia thereon. The first branding indicia may be inside the predefined region such that the predefined region defines the location where the weight is intended to be applied to the golf club head.

In another embodiment, a golf club head may include a rear surface with the first branding indicia thereon. The weight with the second branding indicia may be placed on the rear surface of the golf club head. The weight may completely cover the first branding indicia. The weight may be substantially similar in size and shape to the predefined region on the golf club.

In another embodiment, a golf club head may include a rear surface with the first branding indicia thereon. The weight with the second branding indicia can be displaced from the predefined region exposing some part of the first branding indicia in the predefined region.

In another embodiment, a weighted tape may include second branding indicia thereon, the weighted tape comprising, for example, round, rectangular, or oval-shaped weighted tape adhesively backed with peel off portions.

In another embodiment, a weighted tape may include second branding indicia thereon and comprise a tape portion that can be torn off of a roll or strip of the weighted tape at predetermined lengths marked, for example, by perforated lines or score lines.

In another embodiment, a golf club may include one or more predefined regions on the rear surface of the golf club. The predefined regions may be of any shape and size, and may be sized and shaped to accept a weighted tape of substantially the same size and shape, and may be shaped to accept the weighted tape in only one orientation.

The various exemplary aspects described above may be implemented individually or in various combinations. These and other features and advantages of the golf club head according to the disclosure in its various aspects and demonstrated by one or more of the various examples will become apparent after consideration of the ensuing description, the accompanying drawings, and the appended claims.

BRIEF DESCRIPTION OF THE DRAWINGS

The drawings described below are for illustrative purposes only and are not intended to limit the scope of the present invention in any way. Exemplary implementations will now be described with reference to the accompanying drawings, wherein.

Common reference numerals are used throughout the drawings and detailed description to indicate like elements.

DETAILED DESCRIPTION OF THE INVENTION

Figure 1:
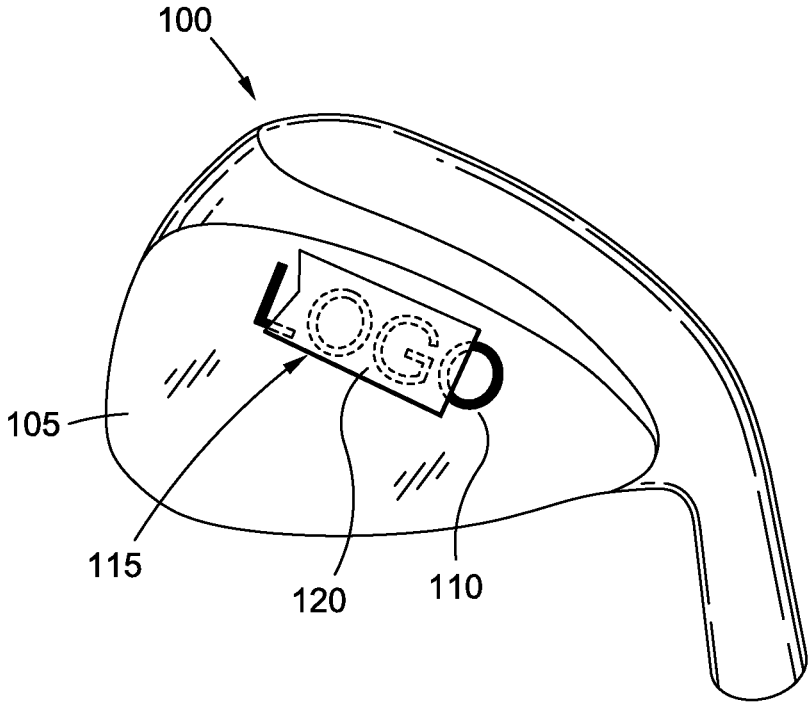
FIG. 1 (Prior Art)
FIG. 1 is a rear view of an exemplary golf club head having a strip or segment of prior art weighted (lead) tape applied to the rear surface thereof in accordance with known application techniques.

Referring now to the drawings wherein the showing are for purposes of illustrating preferred embodiments of the present invention, and not for purposes of limiting the same, FIG. 1 depicts a club weighting system of the prior art, consisting of a golf club head 100 defining a rear surface 105 having branding indicia 110 applied to a prescribed region or area thereof. As illustrated, the prior art club weighting system also consists of a segment of plain lead tape 115 applied over at least a portion of the first branding indicia 110.

In greater detail, in the prior art, the lead tape 115 is applied casually over the branding indicia 110, so that the branding indicia 110 is at least partially obscured. Also, the lead tape 115 has a plain exterior surface 120 with no branding indicia thereon. This arrangement leads to the branding indicia 110 being fully or partially hidden from the viewer due to the overlapping plain lead tape 115. As illustrated, the prior art lead tape 115 is often applied with uneven borders and/or in uncertain weight, and/or in haphazard placement, leading to uncertain repeatability from club to club or when it becomes necessary to replace the lead tape 115.

Figure 2:
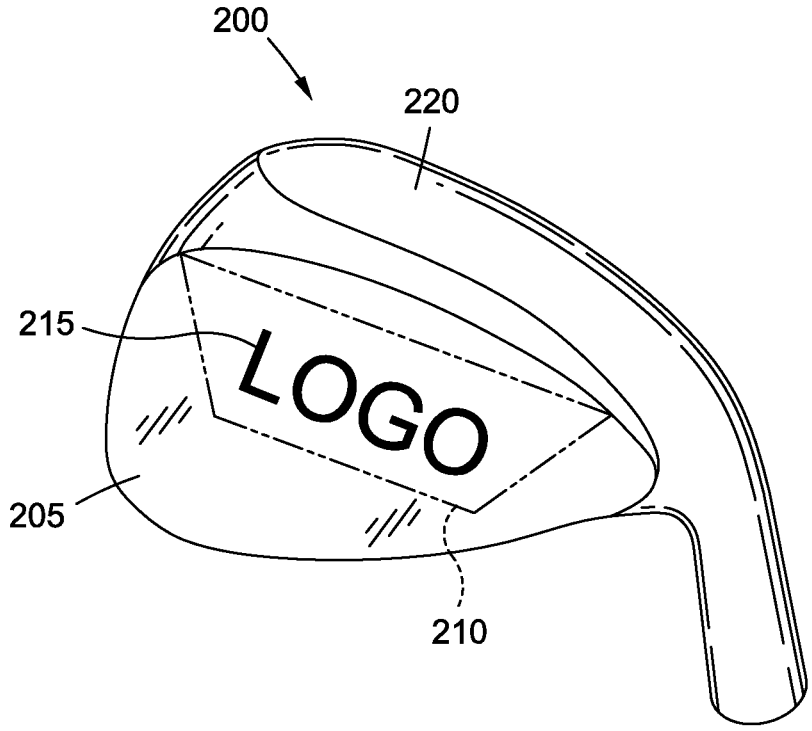
FIG. 2 is a rear view of an exemplary golf club head depicting branding indicia as applied to a prescribed region of the rear surface thereof.

Referring to FIG. 2, there is shown an exemplary golf club head 200 suitable for use in conjunction with the weighting system of the present disclosure. The golf club head 200 minors many of the structural features of the golf club head 100 described above, and defines a rear surface 205. Disposed at a prescribed region or area of the rear surface 205 is a predefined region 210. In many gold club head designs, the predefined region 210 is recessed or elevated relative to the remainder of the rear surface 205, or otherwise differentiated therefrom by some form of a visual line of demarcation. Applied to the club head 200 within the predefined region 210 is first branding indicia 215. The first branding indicia 215 may be formed or placed on or in the rear surface 205 of the golf club head 200 using any known method and, for example, may be etched, embossed, punched, stamped, painted, or lacquered, on the golf club head 200. In FIG. 2, the predefined region 210, and hence the first branding indicia 215, is spaced from the sole 220 of the gold club head 200 by a prescribed distance.

In the golf club head 200 shown in FIG. 2, the first branding indicia 215 may comprise a logo, brand name, or any other form of indicia. In a preferred aspect, the branding indicia 215 may comprise a brand associated with the manufacturer of the golf club head 200, for example, "Cleveland." The predefined region 210 is which the first branding indicia 215 preferably reside may be of any shape and design. As illustrated in FIG. 2, the predefined region 210 may comprise a polygon, such as a trapezoidal region. Those of ordinary skill in the art will recognize that the predefined region 210 may also be provided in sizes and/or shapes varying from that shown in FIG. 2 without departing from the spirit and scope of the present invention. Along these lines, the predefined region 210 may be defined at least in part by indicia selected from the group comprising lines, line segments, arcs, arc segments, dashes, dots, and corner segments. Additionally or alternatively, the predefined region 210 may be defined at least in part by one or more of a partially raised surface, a fully raised surface, a partially sunken or recessed surface, a fully sunken or recessed surface, a stepped surface, a textured surface, and a partially raised/partially sunken or recessed surface.

Figure 3:
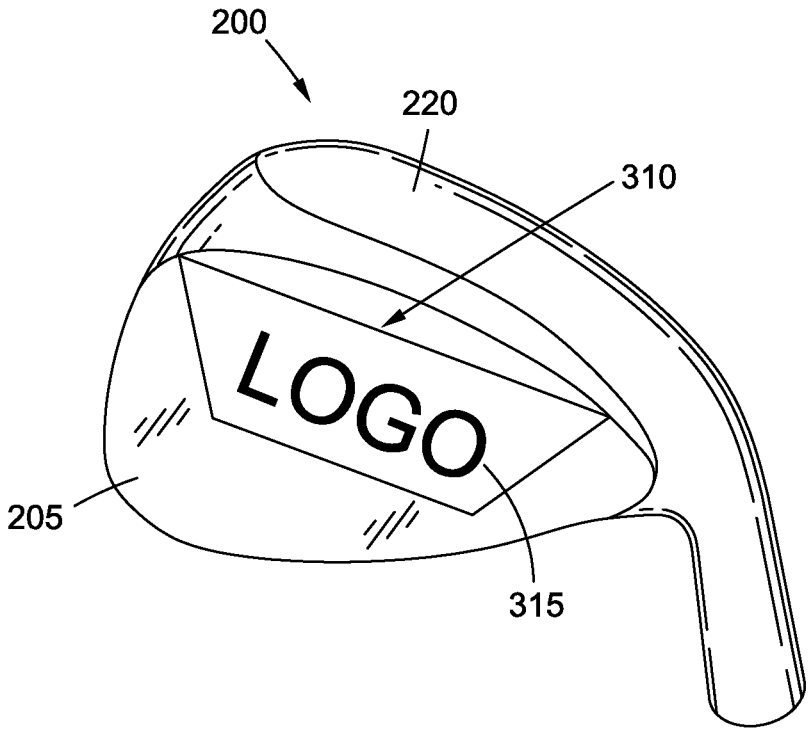
FIG. 3 is a rear view of an exemplary golf club head having a branded weight applied thereto in accordance with one embodiment of the present disclosure.

Referring to FIG. 3, in accordance with one embodiment of the present disclosure, a pre-cut weighted tape segment 310 is applied to the rear surface 205 of the golf club head 200 to facilitate the implementation of the weighting system. The weighted tape segment 310 may be sized and shaped to substantially conform to the size and shape of the predefined region 210 illustrated in FIG. 2. The weighted tape segment 310 may comprise tape that has been scored, perforated, punched, or otherwise pre-sized. As depicted in FIG. 3, the predefined region 210 and the weighted tape segment 310 are substantially similar in size and shape. The weighted tape segment 310 may have second branding indicia 315 on an exterior surface thereof which is substantially similar to the first branding indicia 215 illustrated in FIG. 2.

With greater particularity, the weighted tape segment 310 may substantially or completely cover the first branding indicia 210 illustrated in FIG. 2, and may substantially or completely fit in, fill or otherwise cover the predefined region 210 illustrated in FIG. 2. In FIG. 3, the weighted tape segment 310 is sized and shaped to completely cover the first branding indicia 210 and to completely cover the predefined region 210 as well. As indicated above, the predefined region 210 may be defined at least in part by indicia selected from the group comprising lines, line segments, arcs, arc segments, dashes, dots, and corner segments, which may be formed on the rear surface 205 using known methods including etching, stamping, molding, painting, casting, milling, and the like.

Figure 4:
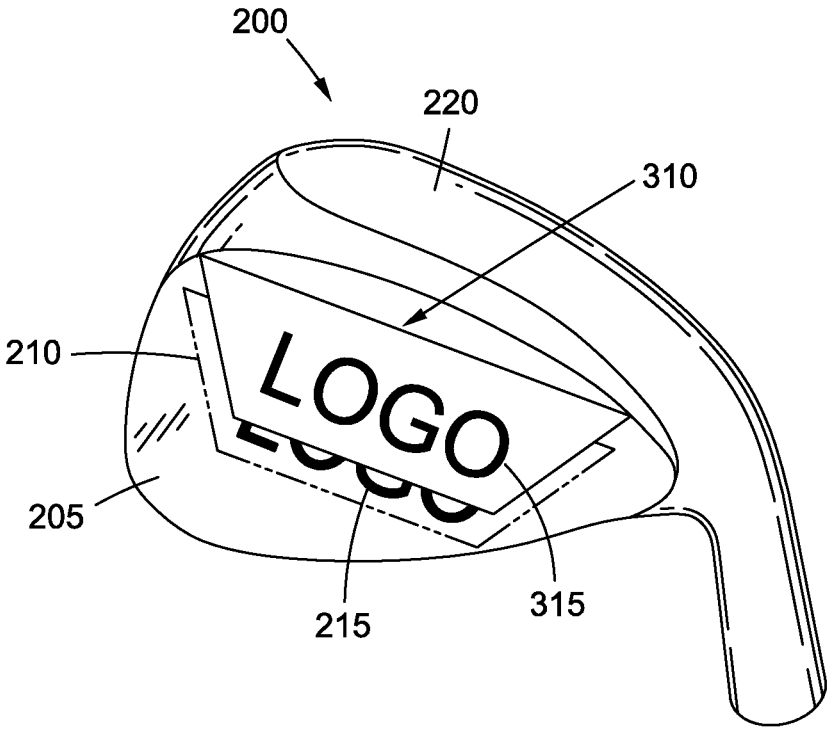
FIG. 4 is a rear view of an exemplary golf club head having a branded weight applied thereto in accordance with another embodiment of the present disclosure.

Referring to FIG. 4, in accordance with another embodiment of the present disclosure, the pre-cut weighted tape segment 310 is applied to a golf club head 200 so as to be disposed slightly offset from the predefined region 210 such that the weighted tape segment 310 substantially, but not fully, covers the first branding indicia 215 in the predefined region 210. In this regard, the weighted tape segment 310, when misplaced or offset in the predefined region 210 on the rear surface 205 of the golf club head 200 may leave some part of the first branding indicia 215 on the predefined region 210 exposed. Thus, even though the weighted tape segment 310 is misplaced or offset, it still has the second branding indicia 315 which may be substantially similar to the first branding indicia 215.

Those of ordinary skill in the art will recognize that in the gold club head 200, the distance separating the predefined region 210, and hence the first branding indicia 215, from the sole 220 as shown in FIGS. 2 and 4 is exemplary only. Along these lines, the techniques described above for applying the weighted tape segment 310 to the golf club head 200 will be, in most instances, unaffected by any increase or decrease in the distance separating the predefined region 210 and/or first branding indicia 215 from the sole 220 from that shown in FIGS. 2 and 4.

Figure 5:
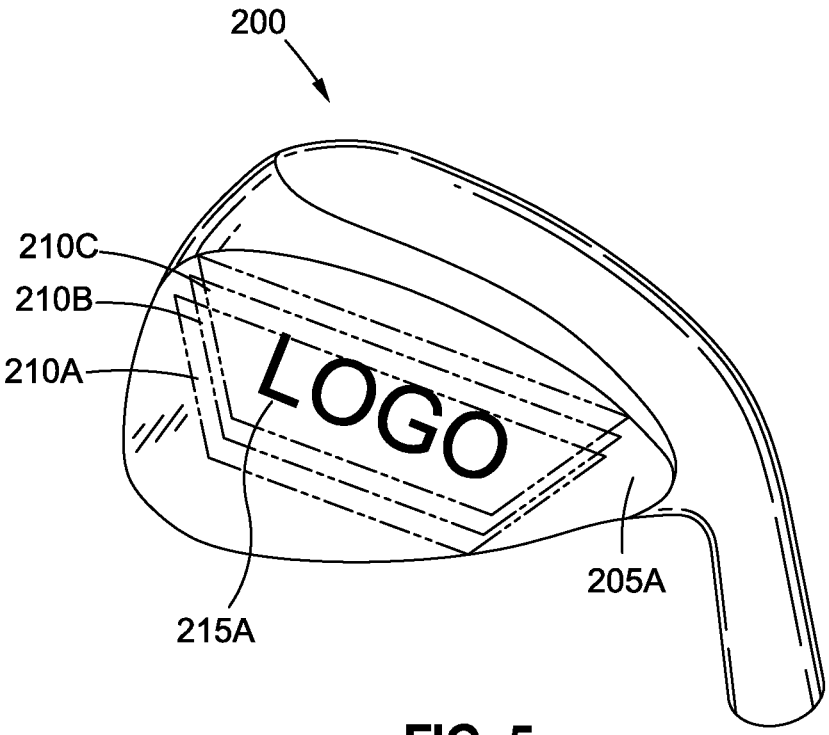
FIG. 5 is a rear view of an exemplary golf club head adapted to have a branded weight applied thereto in accordance with another embodiment of the present disclosure.

Another embodiment of the disclosure is illustrated in FIG. 5. In this embodiment, a golf head 200A is depicted that is similar to the golf club head 200, but includes several predefined regions formed within the rear surface 205A thereof. In greater detail, the golf club head 200A, as illustrated in FIG. 5, is formed to include three predefined regions 210A, 210B, 210C on the rear surface 205A. Such predefined regions 210A, 210B, 210C may, when a weighted tape segment is applied to the golf club head 200A, define and/or represent different center of gravity adjustments (three in this example) to the golf club head 200A. As illustrated, the predefined regions 210A, 210B, 210C may each be sized and shaped substantially the same and/or to substantially "capture" the branding indicia 215A of the golf club head 200A therein. It is contemplated that one or more pre-cut weighted tape segment, like the weighted tape segment 310, may be applied to the golf club head 200A to cover the branding indicia 215A and/or reside on or within one or more of the predefined regions 210A, 210B, 210C. In this regard, regardless of which of the predefined regions 210A, 210B, 210C a weighted tape segment of substantially the same size and shape is positioned, the branding indicia 215A may be substantially covered, and/or be effectively replaced by, for example, the second branding indicia 315 on the pre-cut weighted tape segment 310.

Figure 6:
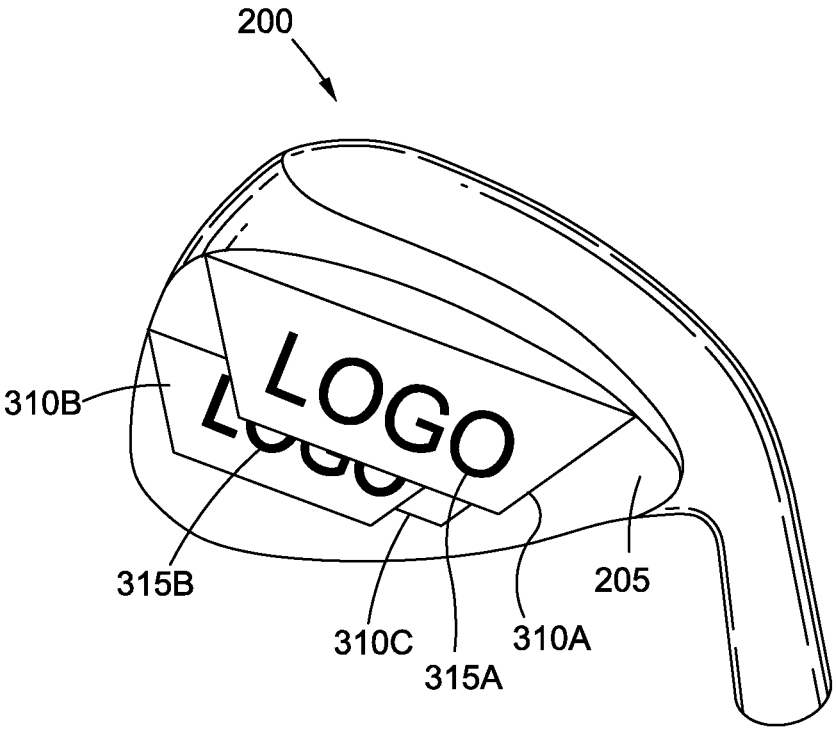
FIG. 6 is a rear view of an exemplary golf club head having several branded weights applied thereto in accordance with another embodiment of the present disclosure.

Another embodiment of the disclosure is illustrated in FIG. 6. In this embodiment, several weighted tape segments of different size, shape and dimension are applied to the rear surface 205 of the golf club head 200. In the exemplary implementation of multiple tape segment usage as depicted in FIG. 6, three weighted tape segments 310A, 310B, 310C of different size and shape are applied to the rear surface 205. As is apparent from FIG. 6, such weighted tape segments 310A, 310B, 310C may contain all or a portion of the second branding indicia 315 shown in relation to the above described weighted tape segment 310. In greater detail and by way of example, the weighted tape segment 310A includes second branding indicia 315A which is complete and minors the second branding indicia 315. On the other hand, the weighted tape segments 310B, 310C include only portions of the complete second branding indicia 315, such as the partial second branding indicia 315B included on the weighted tape segment 310B.

As illustrated in FIG. 6, the weighted tape segments 310A, 310B, 310C may be applied at various positions on the rear surface 205 of the golf club head 200. As depicted, each of the weighted tape segments 310A, 310B, 310C may cover some portion of the predefined region 210 (not shown in FIG. 6) on the golf club head 200. In this aspect, the weighted tape segments 310B, 310C positioned beneath the uppermost weighted tape segment 310A may have all or a part of the second branding indicia thereof, such as the partial second branding indicia 315B, obscured by the top weighted tape segment 310A. Along these lines, the second branding indicia (not shown) included on the lowermost weighted tape segment 310C may be completely or partially obscured by the weighted tape segments 310B and/or 310A. As illustrated in FIG. 6, the second branding indicia 315A on the top most weighted tape segment 310A is preferably fully visible, to give a substantially certain indication of the brand to the viewer.

Figure 7:
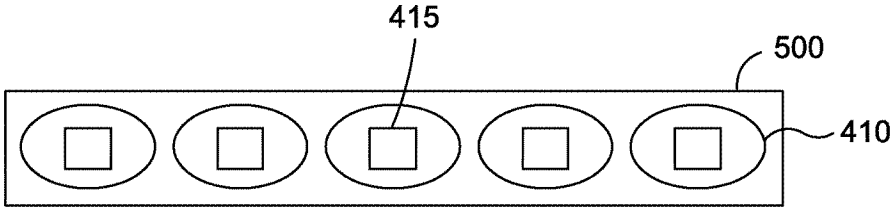
FIG. 7 depicts one potential supply modality for branded weights constructed in accordance with the present disclosure.

Referring now to FIG. 7, it is contemplated that any segment of weighted tape used in the weighting system of the present disclosure may be provided in the form of a weighted tape segment 410 which has second branding indicia 415 thereon. In a preferred implementation, several weighted tape segments 410 are positioned in series and may be selectively peeled from a common base layer 500. In an alternative implementation, the weighted tape segments 410 may be integral portions of the base layer 500 separable from the remainder thereof by the fracture of perforations or frangible score lines. In this alternative implementation, it is contemplated that the side or face of the base layer opposite that including any second branding indicia 415 may have a layer of adhesive applied thereto which is exposed upon the removal of a backing strip (not shown) which covers the same. In FIG. 7, the weighted tape segments 410 are each shown as having an oval shape. However, those of ordinary skill in the art will recognize that other sizes and shapes are contemplated to be within the spirit and scope of the present invention, including those of the above-described weighted tape segments 310, 310A, 310B, 310C. Also, the second branding indicia 415 may be embossed on the corresponding weighted tape segments 410, or printed on a top layer thereof, or printed on an envelope enclosing the same.

Figure 8:
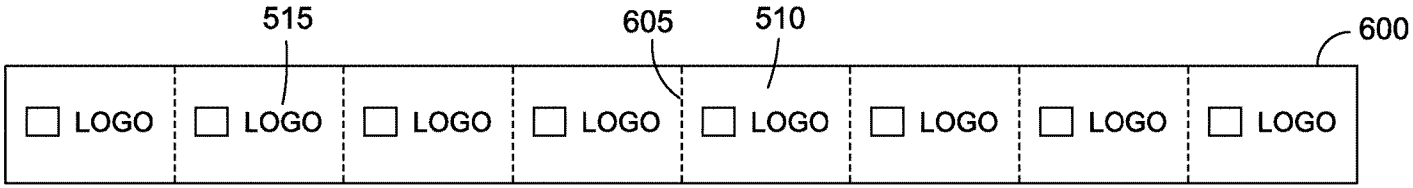
FIG. 8 depicts another potential supply modality for branded weights constructed in accordance with the present disclosure.

Referring now to FIG. 8, it is also contemplated that any segment of weighted tape used in the weighting system of the present disclosure may extracted from within an elongate strip 600 which contains a number of pre-cut weighted tape segments 510 which are each of a pre-defined size, shape and weight. The individual weighted tape segments 610 may each include second branding indicia 515 thereon, are separated from each other within the strip 600 by perforations or frangible score lines 605. These score lines 605, preferably provided at consistent, predetermined intervals, create a consistent look, and allow for the tearing off of the weighted tape segment 510 one at a time, as needed. The second branding indicia 515 may be embossed on strip 600, or printed on a clear or transparent top layer. Each weighted tape segment 510 may comprise a known mass enabling known adjustments to the swing weight and/or center of gravity of the golf club head, such as the gold club head 200, 200A, to which it is applied. Along these lines, it is also contemplated that each of the weighted tape segments 510 may comprise at least one appliqué which itself comprises an adhesive layer applied to corresponding weighted portion.

Figure 9:
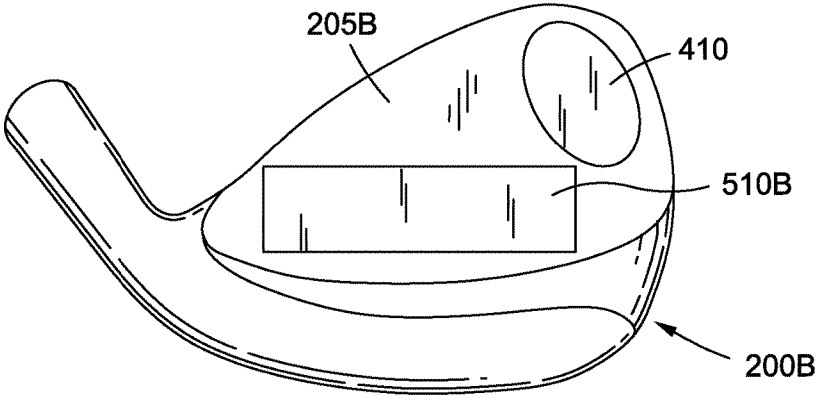
FIG. 9 is a rear view of an exemplary golf club head having adapted to have several branded weight applied thereto in prescribed locations thereon in accordance with another aspect of the present disclosure.

Referring to FIG. 9, there is shown a golf club head 200B which is similar to the golf club head 200 described above, and defines a rear surface 205B. In the golf club head 200B, the rear surface 205B is preferably formed to include one or more pre-defined recommended weighted tape placement positions. In the exemplary embodiment shown in FIG. 9, one of these positions is sized and shaped to be complimentary to, and therefore accommodate, a weighted tape segment 410. A remaining one of the placement positions is sized and shaped to be complimentary to, and therefore accommodate, a weighted tape segment 510B similar to by comprising a slightly elongated version of the weighted tape segment 510. The size and shape of the placement positions, and weighted tape segments 410, 510B applied thereto, as shown in FIG. 9 is exemplary only, in that placement positions of varying size, shape and/or location may be laser etched or otherwise formed in the rear surface 205B. Indeed, these locations could potentially be laser etched into the rear surface based on user's swing as determined, for example, by a fitting application or club fitting procedure. As will be recognized, any weighted tape segments used in conjunction with the golf club head 200B will be provides in sizes/shapes which correspond to those of any placement position(s) formed in the rear surface 205B.

The present disclosure serves to address the problem of the prior art (FIG. 1) by showcasing a similar branding indicia (e.g., second branding indicia 315, 315A, 415, 515)

as is originally on the golf club 200 in the form of the first branding indicia 215. As indicated above, the first branding indicia 215 and the second branding indicia 315, 315A, 415, 515 may be substantially similar in size, or shape, message, or appearance, but in other aspects may comprise different branding indicia and/or different size, shape, message, or appearance.

The pre-cut weighted tape segment 310, 310A, 310B, 310C, 410, 510 may comprise any material, including but not limited to lead, tin, bismuth, steel, ceramic, stone, pewter, tungsten-nickel alloy and mixtures or alloys thereof. In addition, as also indicated above, each pre-cut weighted tape segment 310, 310A, 310B, 310C, 410, 510 may comprise a known mass enabling known adjustments to the swing weight and/or center of gravity of the golf club head to which it is applied.

This disclosure provides exemplary embodiments of the present invention. The scope of the present invention is not limited by these exemplary embodiments. In this regard, while the system, methods, and apparatus of the disclosure have been described and illustrated primarily with respect to a weighted golf club, it will now be readily appreciated that articles other than golf clubs, such as hockey sticks, baseball/softball bats, lacrosse sticks, cricket bats, etc., may be configured as set forth herein, for example, with predefined regions comprising first branding indicia or recommended placement positions for weighted tape, which may also be branded as set forth herein. As such, numerous variations, whether explicitly provided for by the specification or implied by the specification, such as variations in structure, dimension, type of material and manufacturing process may be implemented by one of skill in the art in view of this disclosure.

What is claimed is:

1. An iron-type golf club head weighting system, comprising:

an iron-type golf club head having an exterior rear surface including at least one predefined region on the exterior rear surface at least partially defined by a visual line of demarcation on only a portion of the exterior rear surface, the predefined region being neither recessed nor elevated relative to the remainder of the exterior rear surface, and further being of a first prescribed size and shape comprising a lengthwise section at least partially defined by two spaced, parallel segments of the visual line of demarcation, the iron-type golf club head including first branding indicia thereon within the predefined region, the first branding indicia being of a first appearance and having a lengthwise orientation parallel to the parallel segments of the visual line of demarcation; and a weighted tape segment having a lengthwise section and including second branding indicia thereon, the second branding indicia being of a second appearance the same as the first appearance, so as to effectively maintain the first appearance to a viewer thereof, and having a lengthwise orientation parallel to the lengthwise section of the weighted tape segment, the weighted tape segment being of a second prescribed size and shape the same as the first prescribed size and shape of the predefined region, with the weighted tape segment being removably applied to the exterior rear surface and positioned to cover the predefined region and obscure the first branding indicia while presenting the second branding indicia in substitution for the obscured first branding indicia, the first prescribed size and shape and the second prescribed size and shape being selected to enable removeable application of the weighted tape segment within the predefined region in only one orientation.

2. The system of claim 1, wherein the weighted tape segment is sized and configured to correspond to a desired swing weight of the iron-type golf club head following application of the weighted tape segment thereto.

3. The system of claim 2, wherein the weighted tape segment comprises a weighted layer having an adhesive layer applied thereto.

4. The system of claim 3, wherein the weighted layer comprises one of lead, tin, bismuth, steel, ceramic, stone, pewter, tungsten-nickel alloy and mixtures or alloys thereof.

5. The system of claim 3, wherein the weighted layer comprises an appliqué having the adhesive layer disposed thereon.

6. The system of claim 1, wherein the lengthwise section of the predefined region has a width which is a distance between the two spaced, parallel segments of the visual line of demarcation, and the first prescribed size and shape is selected such that the predefined region is asymmetrical along an imaginary line bisecting at least one of the width or at least one of the two spaced, parallel segments.

7. The system of claim 6, wherein the first prescribed size and shape comprises a trapezoid.

8. The system of claim 7, wherein the first prescribed size and shape comprises a trapezoid that is a non-parallelogram.

9. The system of claim 1, wherein the first branding indicia comprises a first placement location on the exterior rear surface of the iron-type golf club head, and the second branding indicia comprises a second placement location the same as the first placement location upon the weighted tape segment being removably applied to the exterior rear surface.

10. The system of claim 1, wherein the visual line of demarcation at least partially defining the predefined region is defined at least in part by indicia selected from the group comprising lines, line segments, arcs, arc segments, dashes, dots, corner segments, and combinations thereof.

11. The system of claim 1 wherein the visual line of demarcation is formed on the exterior rear surface by etching, painting, or stamping.

12. The system of claim 11 wherein the visual line of demarcation is defined at least in part by indicia selected from the group comprising lines, line segments, arcs, arc segments, dashes, dots, and corner segments.

* * * * *